US006456177B1

(12) United States Patent
Linnarud et al.

(10) Patent No.: US 6,456,177 B1
(45) Date of Patent: Sep. 24, 2002

(54) HOLDER DEVICE FOR A CONTACT ELEMENT

(75) Inventors: Krister Linnarud; Joakim Wåhrenberg; Arne Axelsson; Mats Johansson, all of Västerås; Tomas Baltzer, Enkoping, all of (SE)

(73) Assignee: ABB AB, Västerås (SE)

( * ) Notice: Subject to any disclaimer, the term of this patent is extended or adjusted under 35 U.S.C. 154(b) by 0 days.

(21) Appl. No.: 09/889,481

(22) PCT Filed: Jan. 21, 2000

(86) PCT No.: PCT/SE00/00133

§ 371 (c)(1),
(2), (4) Date: Oct. 9, 2001

(87) PCT Pub. No.: WO00/45407

PCT Pub. Date: Aug. 3, 2000

(30) Foreign Application Priority Data

Jan. 28, 1999 (SE) ..... 9900279

(51) Int. Cl.[7] ..... H01H 67/02
(52) U.S. Cl. ..... 335/106; 335/132

(58) Field of Search ..... 335/106, 127–135; 200/16 A, 16 C, 16 R, 1 A, 243–251, 280, 281

(56) References Cited

U.S. PATENT DOCUMENTS

| | | | | |
|---|---|---|---|---|
| 4,489,296 A | * | 12/1984 | Guery et al. | 200/243 |
| 4,594,484 A | | 6/1986 | Lemmer | 200/16 A |
| 4,893,102 A | * | 1/1990 | Bauer | 335/132 |
| 5,233,321 A | | 8/1993 | Blanchard et al. | 335/132 |
| 5,635,886 A | | 6/1997 | Pichard | 335/132 |

* cited by examiner

*Primary Examiner*—Ramon M. Barrera
(74) *Attorney, Agent, or Firm*—Dykema Gossett PLLC

(57) ABSTRACT

A contact element of a relay, operative for closing and breaking a power supply circuit, respectively, and comprising a contact element (5) for establishing a current path over a pair of connection means (3, 4) in the circuit closing mode, the contact element being received in a socket (10) that is arranged to be movable relative to the relay, and a spring element (22) is operative for holding the contact element in the socket such that the contact element is detachable from the socket against the action of said spring element, in a circuit breaking mode.

5 Claims, 3 Drawing Sheets

HOLDER DEVICE FOR A CONTACT ELEMENT

TECHNICAL FIELD OF THE INVENTION

The present invention relates to a holder device for a circuit breaking contact in a relay, and more specifically to a contact that is operative for closing and breaking a power supply circuit, respectively. In a circuit closing mode, the contact has a contact element that closes the current path over a pair of conductor connections, said contact element being received in a holder that is movable in the relay and permits the contact to be released against the action of a spring.

Such contacts typically are used in relays for closing and breaking a power supply circuit, e.g. for a triple-pole alternating current. The relay or contactor may be manually or electrically controlled. In the last case, the movement of a magnet is employed to close or to break the current path through the contact element. In addition to the main contacts, the relay may also comprise secondary contacts and conductor connections for the control power, which may be controlled manually or electronically.

In industrial applications these contactors or relays are used as motor switches, e.g., and are typically arranged in centrals that are supplied with operation power current and control power to serve a number of current consumers. Accordingly, these centrals may include a large number of conductors and relays, that require maintenance and replacement of worn out components such as the contact elements of the main contacts.

In such installations, there is an existing need to reduce service interrupts during maintenance procedures by facilitating the access to worn out components and replacement parts, and to minimize the number of separate details required for assembly and disassembly of the relay in connection with such maintenance.

OBJECT OF INVENTION

The object of the invention is to meet above said need by providing a holder device for a contact element, through which the contact element may be released manually without the need for tools, and wherein the contact element is releasable against the action of a spring element.

According to the invention, this object is met when the contact element is detachably received in a yoke, and a spring element is anchored in the yoke to act between said yoke and a carrier wherein the yoke is inserted. In the received position, the contact element is clamped between the yoke and said carrier to be released as the yoke is displaced relative to the carrier, against the action of the spring element.

The characterizing features of the invention are defined in the attached claim 1, and preferred embodiments are defined in the sub-claims.

DRAWINGS

The contact element of the invention is further disclosed below in connection with an example thereof, and with reference to the attached drawings. In the drawings FIG. 1 is a section through a relay in a plane that is parallel to the power current direction, in a circuit breaking position;

DETAILED DESCRIPTION

With reference to the attached drawings, a contactor 1 is illustrated that is structured for implementation of an embodiment of the invention.

The contactor 1 is an electromagnetic relay operative to control a three phase system power supply. Thus, said contactor 1 comprises connections for system power, contacts, electric magnet, coil and connections for the control power as known per se, and may further include elements for adapting the contactor to a specified application.

Figure 1:
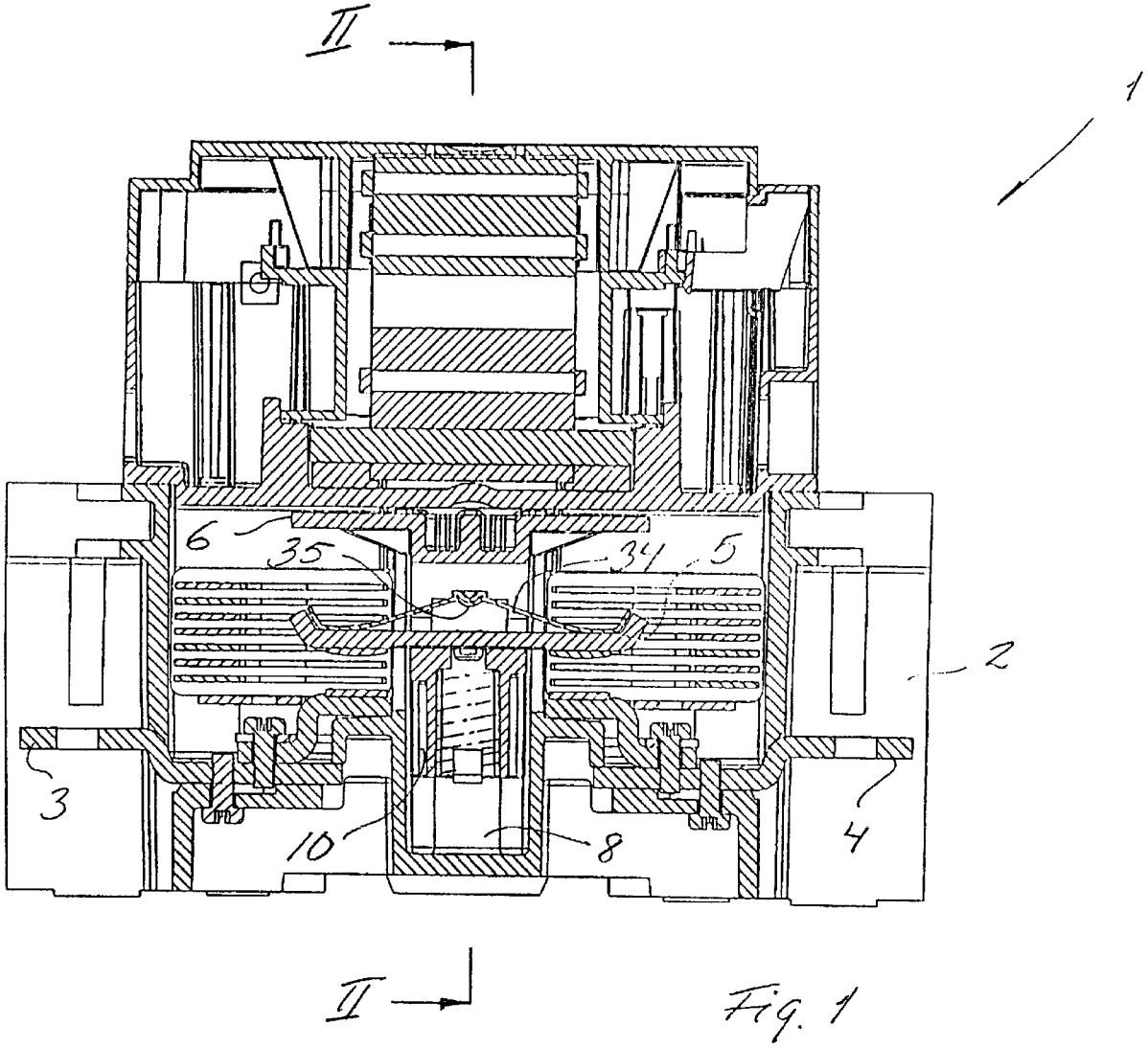

A contactor house 2 is permanently positioned in the current path through fastening means, not further shown, so that a bottom side of the house is seated on a support structure. Input and output connection means 3,4 are accommodated in the bottom area of the house 2, as best seen in FIG. 1, for connecting the system power phase conductors to the conductor 1. In the shown embodiment, the connection means 3,4 are two-part elements that are fixedly mounted by screws in the house 2, and may preferably be located in disconnection cells formed in the house 2 and equipped with arc-shielding means.

Each pair of connection means 3,4 is associated with a separate contact element 5. The contact element 5 is supported to be movable from a circuit breaking position shown in FIGS. 1 and 2, to a circuit closing position wherein the contact element 5 is moved to engagement with the connection means 3,4. The contact elements 5 are supported in a circuit breaking bridge or carrier 6, that is movable in the house 2 against the force of springs 7. The springs 7 are seated in spring guides 8 extending out from the bottom of the house 2. The carrier 6 is bridge-shaped to reach transversely over the contactor. Shoulders 9, acting as seats for the springs 7, are formed in the bottom surface of the carrier 6. Each contact element 5 is supported in a socket 10, extending out from the bottom surface of the carrier, and seated to be biased by a spring as is further described below. Preferably, the socket 10 is integrally formed in the house 2 to provide separate paths for the system power through the contactor 1.

The carrier 6 is formed with a pair of columns 11,12 extending out from the upper surface of the carrier. Between upper ends of the columns 11,12 there is supported an electromagnet armature 13, resting on seats 14 formed on the columns or in separate holders, engaging the columns to transfer the armature movement to the carrier and the contact elements 5 in a circuit closing motion.

An electromagnet armature having a magnetized core 15 and a coil 16 is supported on the upper side of the carrier. Moreover, and not further disclosed, the house 2 and the carrier 6 are suitably formed to guide and facilitate the carrier movement between the circuit closing and breaking positions.

Figure 5:
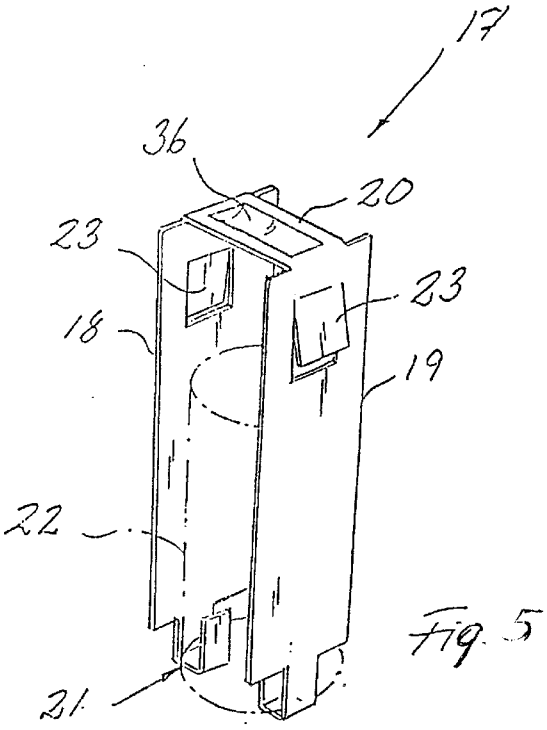
FIG. 5 is a perspective view showing the inventive yoke to be movably received by the carrier.
Figure 4:
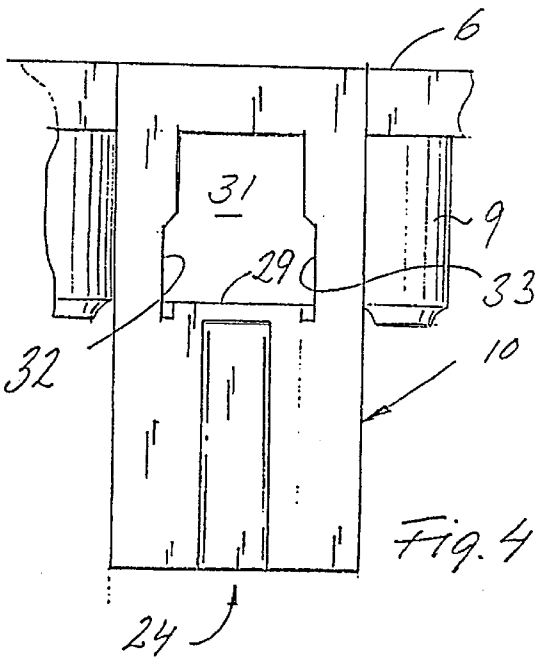
FIG. 4 illustrates the carrier device in a partially broken away elevation view.
Figure 3:
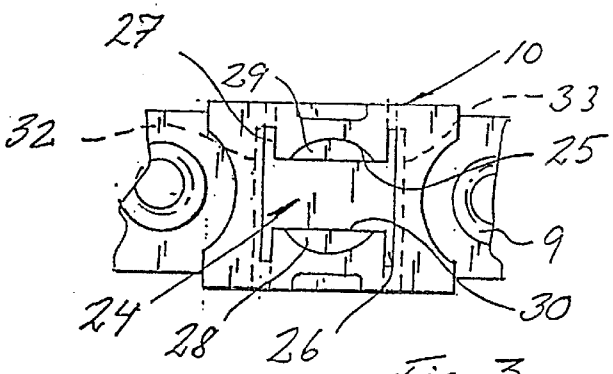
FIG. 3 is a partial end view of a contact element carrier device according to the invention.

The socket 10, as is best seen in FIGS. 3 to 5, is formed to receive a yoke 17 that is axially movable in the socket 10.

In two opposite sides, said yoke 17 comprises legs 18,19 running in parallel.

In one end, the legs are joined by a transverse portion 20. Said portion is formed to a shoulder 20 adapted for holding a contact element 5 as is further described below. In the opposite end, the legs 18,19 comprise a seat 21 for a coiled spring 22, shown in dash-dot lines. In the shown embodiment, said seat 21 is formed by portions of the legs, bent in reverse direction such that one end of the coiled spring 22 is anchored in the bent portions to be supported between the legs 18,19. The other end of the spring 22 is free to engage a counter force shoulder formed in the socket 10, which is further described below. Preferably, the yoke 17 is integrally formed by bending a sheet material, such as plate steel.

Each leg 18,19 of the yoke has a lug 23, as best seen in FIG. 5. As the yoke is received in the socket 10, said lug 23 interacts with a recess formed in the socket for limiting the yoke motion in the socket and preventing the yoke from falling out of the socket.

A hollow space 24 is formed to open in the end of the socket 10, wherein the yoke 17 and the spring 22 are received. Said hollow space 24 comprises a passage 25 having two opposing slots 26,27, substantially tangential to the passage wall. In a bottom of the hollow space, the passage 25 is longitudinally defined by a pair of shoulders 28,29. As is described below, said shoulders form a counter support for the coiled spring 22 and extend partially within the sectional area of the passage, where a spacing or opening 30 between the shoulders form a transverse connection between the slots 26,27. Inwardly of shoulders 28,29, a passage 31 runs through the socket 10 to receive the contact element 5 such that the contact element is oriented transversally to the passage 25 and the socket 10 in the inserted position.

The slots 26,27 reach into the passage 31 and are formed in the outer sides with a recess 32 and 33, respectively. In installation, the yoke 17 and spring 22 are inserted in the hollow space 24 such that the legs 18,19 are received in the slots 26,27. The shoulder 20 is dimensioned relative to the width of the spacing 30 such that the shoulder is free to pass through the spacing 30 and pass the shoulders 28,29, until the lugs 23 engage and lock into the recesses 32,33. In this position, an end portion of the yoke 17 as well as the shoulder 20 projects through the spacing 30 and partially into the through passage 31, while the coiled spring 22 is arrested by the shoulders 28,29 so that the yoke lugs 23 are biased for engagement with a lower end of the recesses 32 and 33, respectively.

In the longitudinal extension of the socket 10, the recesses 32,33 are dimensioned to provide a free space for the lugs 23 so that the yoke 17 is permitted a certain freedom of movement in the received position in the socket 10. Thus, the yoke 17 may be further displaced inwardly against the action of the coiled spring 22, such that the shoulder 20 projects further inside the passage 31 for insertion of the contact element into the yoke 17. As the coiled spring 22 successively is permitted to return the yoke towards the locking engagement between lugs 23 and recesses 32,33, the contact element is clamped to be arrested in contact with the bottom of the passage 31, i.e. against the inner sides of the shoulders 28,29, before the lugs are stopped by the lower end of the recesses.

The contact element 5, as best seen in FIG. 1, comprises an elongate element that preferably is associated with a controlling, arcuate leaf spring 34. A central portion of the leaf spring 34 may be formed with a transverse groove 35, as in the shown embodiment. As the contact element is received in the yoke 17, said groove 35 engages a ridge 36, correspondingly formed in the shoulder 20. This way, the contact element and associated leaf spring are pivotally supported about a transverse axis that permits a certain amount of adjustability in a circuit closing mode, and yet not risking that the contact element is displaced from the yoke 17.

Figure 2:
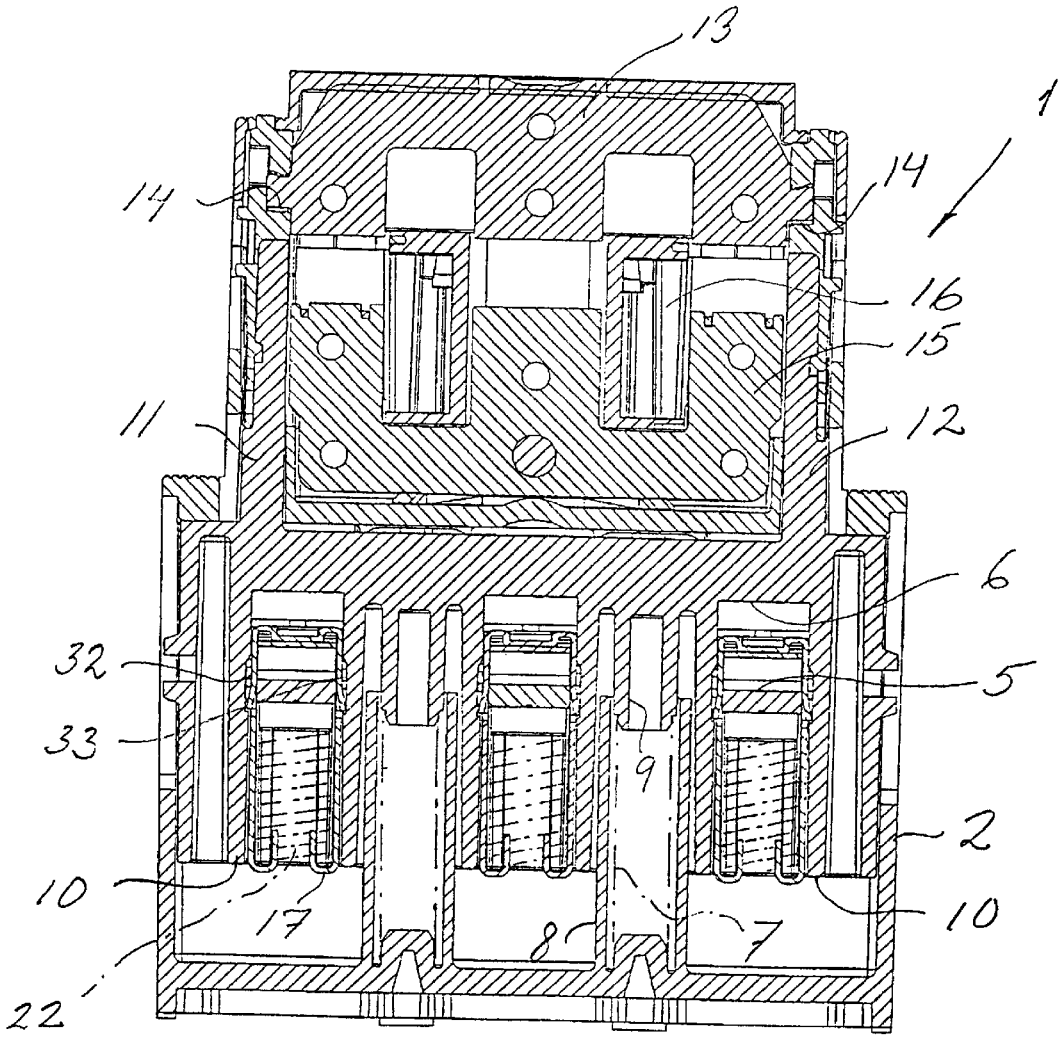
FIG. 2 is a section along the plane II—II of FIG. 1.

In the illustrated embodiment, three sockets 10 are included in a carrier 6, as best seen in FIG. 2. The carrier is structured to be movable in a contactor house 2, between a circuit closing and circuit breaking position, respectively. Shoulders 9 are formed in the intermediate spaces between the sockets 10, said shoulders forming seats or counter supports for springs 7 that run in guides 8, formed in the contactor house. In the circuit breaking motion, the springs 7 are operative for lifting the carrier and the sockets 10 with the contact elements 5 received therein, so that the contact elements are brought from engagement and contact with the conductor connections 3,4. From the drawings and previous disclosure, it will be understood that in the circuit closing position the contact elements 5 are biased for contact with said connections 3,4 through the action of the coiled spring 22, as the contact elements are brought to engagement with the connections in the circuit closing motion of the carrier, whereby the yoke 17 eventually is displaced relative to the socket 10.

In the foregoing, the invention is described in connection with a preferred embodiment from where modifications of the detailed design of the socket, yoke and contact elements are possible without parting from the inventive teachings. Thus, the attached claims are drafted to define the basic inventive solution that meets the above object, which is to provide a contact arrangement for a relay wherein a minimum number of separate elements are manually operated for assembly and disassembly without the need for tools.

What is claimed is:

1. A contact element for a relay, operative for closing and breaking a power supply circuit, respectively, and comprising a contact element (5) for establishing a current path over a pair of connection means (3,4) in the circuit closing position, said contact element (5) being supported by a yoke (17) that is movably received in a socket (10), the yoke (17) enclosing the contact element (5) to be removably received in the socket (10), characterized by a spring element (22) acting between the yoke (17) and a shoulder (28,29) that is formed on the socket (10), wherein the yoke (17) is displaceable against the action of said spring (22) for detaching the contact element (5) from the socket, and the yoke (17) and socket (10) having interacting locking means (23;32,33) for holding the yoke in the socket when the contact element is detached.

2. The contact element of claim 1, characterized in that the yoke (17) carries said spring (22), one end of which is anchored in a seat (21) formed on the yoke, and the other end of the spring acts upon the shoulder (28,29), formed on the socket, when the yoke (17) is received in the socket (10).

3. The contact element of claim 1, characterized in that the shoulder (28,29) has a transverse opening (30) that divides the shoulder in two, and the inner end of the yoke (17) is inserted through the opening as the yoke is received in the socket (10).

4. The contact element of claim 1, wherein said locking means of the socket (10) and the yoke (17) comprise snap lock means (23;32,33) that limit the yoke motion relative to the socket and prevent the yoke from falling out of the socket as the contact element (5) is detached from the socket.

5. The contact element of claim 1, comprising said yoke (17) formed to have a pair of legs (18,19), in one end joined by a transverse portion (20), wherein the transverse portion (20) is shaped for pivotal engagement with a leaf spring (34), associated with the contact element (5) for controlling the same.

* * * * *